United States Patent [19]

Hartkorn

[11] 4,282,620

[45] Aug. 11, 1981

[54] JOINT BRIDGING CONSTRUCTION FOR BRIDGES OR LIKE STRUCTURES

[76] Inventor: Alfred Hartkorn, Kolpingstrasse 25, 8068 Pfaffenhofen-Ilm, Fed. Rep. of Germany

[21] Appl. No.: 61,681

[22] Filed: Jul. 30, 1979

[30] Foreign Application Priority Data

Aug. 4, 1978 [DE] Fed. Rep. of Germany ..... 2834361

[51] Int. Cl.[3] ..... E01D 19/06; E01C 11/02

[52] U.S. Cl. ..... 14/16.5; 404/68; 404/44; 52/396

[58] Field of Search ..... 404/68, 69, 47, 19, 404/20, 44; 14/16.5; 49/489; 52/396

[56] References Cited

U.S. PATENT DOCUMENTS

| | | | |
|---|---|---|---|
| 1,738,571 | 12/1929 | Gare | 404/19 X |
| 2,622,286 | 12/1952 | Beck | 49/489 X |
| 2,909,916 | 10/1959 | Johnssen | 52/396 X |
| 3,090,646 | 5/1963 | Johnssen | 49/489 X |
| 3,732,021 | 5/1973 | Rizza | 14/16.5 X |

FOREIGN PATENT DOCUMENTS 1038922 8/1966 United Kingdom .

*Primary Examiner*—Nile C. Byers, Jr.

[57] ABSTRACT

A sealing body member for attaching into an edge beam having upwardly extending arms, wherein at least one of the upwardly extending arms and the adjacent sealing body have respective mirror image longitudinal recesses, and a dowel part for inserting into the recesses, where the sealing body has a longitudinal cut above the recesses and approximately adjacent the upper edge of the upwardly extending wall to permit the sealing body upper part to be folded for inserting the dowel part from above into the recesses.

6 Claims, 3 Drawing Figures

JOINT BRIDGING CONSTRUCTION FOR BRIDGES OR LIKE STRUCTURES

BACKGROUND OF THE INVENTION

This invention relates to a joint bridging construction for bridges or like structures where sealing bodies, which are flush with the upper side of the roadway and are made of elastic material, are with the aid of beads inserted from above in upwardly open recesses of the edge beams and, as the case may be, of movable intermediate members and are secured against being drawn out by holding bodies which are substantially circular in cross-section.

In the prior art, a number of joint bridging constructions have been developed which have several disadvantages. For example, German Offenlegungsschrift No. 2,516,427 (FIG. 4) has made known such a joint bridging construction. The edge beams or intermediate members in this known construction each have an upwardly open groove into which the sealing body is inserted; the flanks of the grooves are obliquely arranged so that the grooves narrow in upward direction. Those rims of the sealing body which face toward the flanks are recessed such that the holding body can be moved between the flank walls and the sealing body in the direction toward the edge beam or the intermediate member. Since on the one hand the sealing body is exposed to very strong suction forces which in the direction transverse to the joint are caused by the load of the vehicles driving on the roadway, there is the danger that the sealing body gets out of its groove; the recess between the groove wall and sealing body wall is also exposed to contaminations from the roadway surface. Finally, the movable members defining the grooves extend upwardly to the roadway surface so that when a vehicle drives on the joint bridging construction, noises are caused thereby.

German Pat. No. 2,511,278, issued Dec. 8, 1977, shows another joint bridging construction for bridges or like structures where the edge beads of the sealing body are anchored in horizontal recesses in the edge beam or intermediate member and where is also provided a similar doweling between sealing body and edge beam or intermediate member, insertion and removal of the known sealing body is relatively difficult and is impossible if the joint is closed.

SUMMARY OF THE INVENTION

The present invention solves the problem of providing a joint bridging construction having an absolutely reliable anchorage and seal between the members of such a structure. The problem has inventively been solved in that the walls of the recesses extend approximately parallel to each other, the holding body is in the form of a dowel one part of which is fit into a wall of the recess and the other part of which is fit into the bead, and there is provided a cut above the dowel at the height of the upper side of the edge beam or the intermediate members.

That is to say, the above memtioned cut at the height of the upper side of the edge beam or the intermediate members facilitates decisively the work of placing since by turning up on the free rims of the sealing body there is not only provided the possibility exactly to observe the fitting on of the holding body which acts as a dowel but also to guarantee that the anchorage is made everywhere at the correct location.

According to a preferred embodiment of the invention, the wall of the recess receiving the dowel can upwardly slightly diverge relative to the other wall.

BRIEF DESCRIPTION OF THE DRAWING

The drawing shows several embodiments of the invention in schematically simplified manner; they are below described in more detail. There is shown by FIG. 1 a cross-section through one part of a first embodiment.

DESCRIPTION OF THE PREFERRED EMBODIMENT

Figure 1:
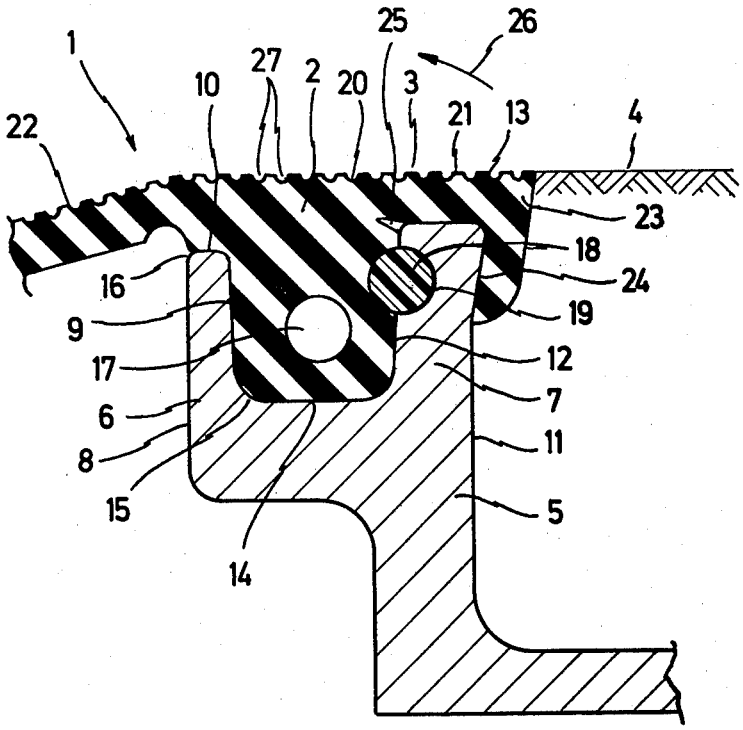

Referring first to FIG. 1, there is shown a sealing body 1 which has a bead 2 whose upper side 3 is flush with the upper side 4 of the structure; the sealing body can in a conventional manner be foldable and is made of a rubber-elastic material.

The upper side 4 can for example be the roadway of a bridge; it can, however, also be the upper side of structures which can be driven on. The upper side of a structure or a roadway can be made of concrete, bitumen or asphalt or of similar materials.

The bead 2 is anchored in an edge beam 5 which is made, for example, of cast steel. The edge beam 5 has two arms 6 and 7 extending vertically to the upper side 4. The arm 6 has an outer wall 8 which extends approximately vertically and an inner wall 9 which extends parallel thereto; the upper edge 10 of the arm 6 extends horizontally.

The opposite outer wall 11 of the edge beam 5 extends also substantially vertically and approximately parallel to the corresponding inner wall 12 of the arm 7; the latter wall, however, can be slightly outwardly inclined and for example extend at an angle from 5° to 20° relative to the vertical line. The upper side 13 of the arm 7 of the edge beam 5 extends again parallel to the upper side 4 of the structure.

The two walls 9 and 12 are connected to each other by a horizontally extending wall 14; the respective transition portions, for example 15 or 16, are rounded off. The bead 2 of the sealing body 1 is with its outer surfaces with minor tolerances adapted to the corresponding walls of the edge beam 5. In the bead 2, there is provided a recess 17 which extends in the longitudinal direction of the joint and which when the sealing body is inserted by means of a holding body 18 being in the form of a circular dowel, receives part of the material of the bead 2 to be forced out.

In the arm 7 of the edge beam 5, there is provided a semi-circular recess 19 which corresponds to a mirror image equal recess 20 in the bead 2.

Whereas the sealing body 1 as usual can be made of polychloroprene, the holding member 18 is made either of the same material having, as the case may be, a low proportion of a softener added thereto, or of metal. It is self-evident that one can also use a different synthetic material which has the required properties with regard to density, freedom from shrinkage and resistance to aging.

From the bead 2 of the sealing body 1 extends a narrow portion 21 above the arm 7 which portion is approximately 9 mm thick, i.e. it has approximately the thickness the sealing body has in the folding region 22.

The rim 23 of the sealing body overlaps the arm 7, the upper portion 24 of the outer wall 11 again extending at an angle of from 5° to 20°, for example, to the vertical line.

In the sealing body 1, there can above the recess 20 be provided a cut 25 extending in the longitudinal direction of the joint and serving as a possible buckling point so that the rim portion of the sealing body can in the direction of the arrow 26 be lifted to make easier insertion of the holding body 18 when the sealing body 1 is being anchored.

Because of its uniform and substantially flatly extending surface portions, the edge beam 5 can be manufactured in a relatively simple and economical manner; the same applies also to the region of the bead 2 of the sealing body 1; the latter can on its upper side to be driven on be provided with grooves 27.

Figure 2:
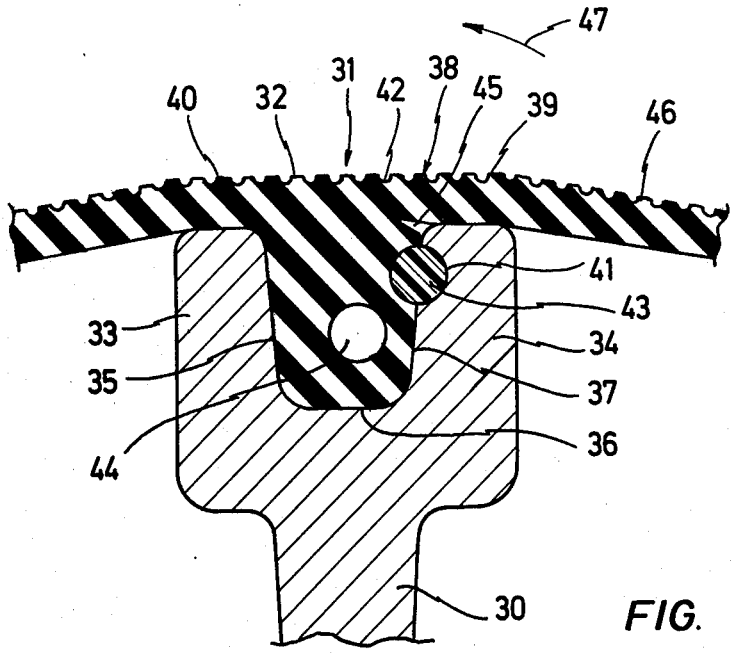
FIG. 2 a cross-section through one part of a modified embodiment.

As is shown in FIG. 2, in the embodiment represented, an intermediate member 30 of a joint bridging construction is in the usual manner movably placed within the joint; the intermediate member 30 can via a control device be connected to the edge beams 5, said control device guaranteeing that when the distance of the edge beam is reduced or enlarged, the intermediate member 30 maintains always its central position.

The sealing body 31 has a bead 32 which engages the arms 33 and 34, the mirror image of which is approximately identical, and is anchored between said arms. In case of this embodiment, too, the walls 35, 36, and 37 extend approximately at right angles to each other, the wall 36 extending parallel to the roadway upper side 38. The upper sides 39 and 40 of the two arms 33 and 34 extend also parallel to the upper side 38 of the roadway and in this embodiment have the same height. Only in the arm 34 there is provided a semi-circular recess 41 which extends in the longitudinal direction of the joint and to which is associated a corresponding recess 42 in the bead 32 whose mirror image (of 42) is identical with the said recess 41. The two recesses receive a holding body 43 which is in the form of a dowel and extends in the longitudinal direction of the joint.

A recess 44 extending in the longitudinal direction is provided, as shown in FIG. 2, in the vicinity of the holding body 43 to be inserted later. The cross-section of the recess 44 should at least be as large as half the cross-section of the holding body 43 since the right-hand portion 46 of the sealing body 31 can better be lifted in the direction of the arrow 47.

In order to be able to firmly secure or clamp the sealing body in the individual constructional members in the intended manner, it is proceeded such that first the respective beads 32 are anchored in the intermediate member 30 or in the corresponding intermediate members and only then they are secured in the edge beams.

Figure 3:
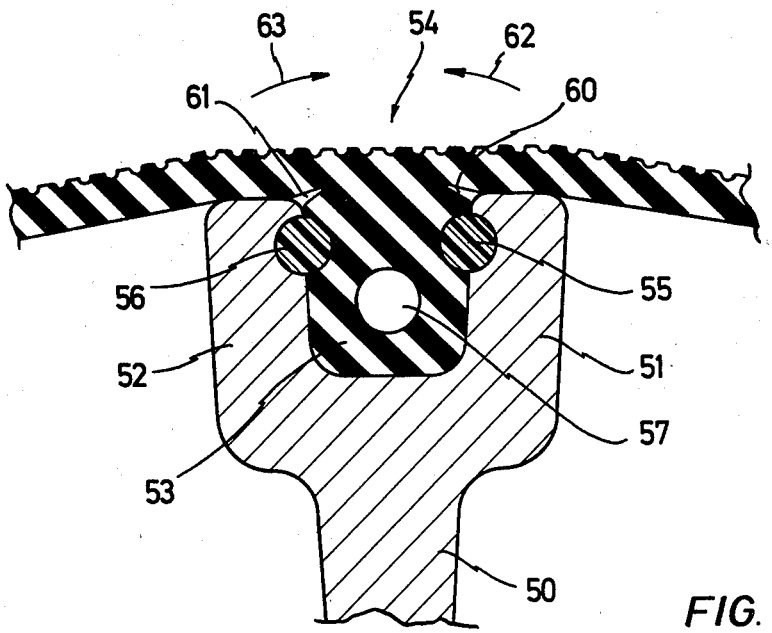
FIG. 3 a cross-section through one part of a third embodiment.

According to the embodiment shown in FIG. 3, an intermediate member 50 is provided with two arms 51 and 52 whose mirror image is identical. The recess for receiving the bead 53 of a sealing body 54 has a form which is similar to that of the corresponding recess shown in FIG. 2, except the difference that in this case there are provided on either side the holding bodies 55 and 56. The centrally arranged recess 57 here has at least the cross-section of one of the holding bodies 55 or 56.

The two holding bodies need not have the same cross-section; instead of selecting the most favorable circular cross-section of the holding bodies 55 or 56, it is also possible to use a non-circular cross-section, particularly an oval cross-section; if however one deviates from the circular cross-section, there might result difficulties when securing the bead and above all when inserting the holding body.

In the embodiment as shown in FIG. 3, there are also provided cuts 60 and 61 whereby buckling points are caused and which make possible lifting of each of the sealing bodies in the direction toward the arrows 62 and 63, respectively, so that the holding bodies 55 and 56 can be inserted more easily.

What is claimed is:

1. In a joint bridging construction for bridges or like structures where sealing bodies which are flush with the upper side of the roadway and are attached into recesses between upwardly extending walls in edge beams, the improvement comprising a longitudinal recess along at least one of said upwardly extending walls; a mirror image and facing longitudinal recess extending along said sealing body; a dowel part sized to snugly fit into both of said longitudinal recesses; and a longitudinal cut in said sealing body above said sealing body longitudinal recess, and adjacent the top edge of said upwardly extending wall.

2. The improvement of claim 1, further comprising a second longitudinal recess in said sealing body below said longitudinal recesses and between said upwardly extending walls.

3. The improvement of claim 1, wherein said upwardly extending walls diverge slightly outward.

4. The improvement of claim 1, wherein said sealing body further comprises portions which extend over said upwardly extending arms and are adapted to lay flush on said roadway.

5. The improvement of claim 4, wherein said longitudinal cut in said sealing body is along the juncture of said extended portions and the portion which fits between said upwardly extending arms.

6. The improvement of claim 1, further comprising longitudinal recesses in both of said upwardly extending walls, respective facing and mirror image longitudinal recesses in said sealing body and dowel parts sized to snugly fit into each of said wall and sealing body recesses.

* * * * *